US005762386A

United States Patent [19]

Fuehrer

[11] Patent Number: 5,762,386

[45] Date of Patent: Jun. 9, 1998

[54] TAMPER RESISTANT SEAL AND METHOD OF SEALING AN OBJECT

[75] Inventor: Charles Fuehrer, Scarsdale, N.Y.

[73] Assignee: Stoffel Seals Corporation, Tuckahoe, N.Y.

[21] Appl. No.: 561,411

[22] Filed: Nov. 21, 1995

Related U.S. Application Data

[63] Continuation-in-part of Ser. No. 375,691, Jan. 20, 1995, abandoned.

[51] Int. Cl.[6] ..... B65D 27/30

[52] U.S. Cl. ..... 292/307 R; 292/320

[58] Field of Search ..... 292/307 R, 307 B, 292/325, 321, 317–319, 320

[56] References Cited

U.S. PATENT DOCUMENTS

| | | | |
|---|---|---|---|
| 2,599,700 | 6/1952 | Di Palma | 292/323 |
| 2,656,209 | 10/1953 | Conaway, Sr. | 292/319 |
| 2,988,391 | 6/1961 | Erke | 292/325 |
| 3,591,223 | 7/1971 | De Lima Castro Netto | 292/320 |
| 3,712,655 | 1/1973 | Fuehrer | 292/321 |
| 3,717,369 | 2/1973 | Stoffel et al. | 292/321 |
| 4,506,921 | 3/1985 | Swift | 292/318 |
| 4,697,833 | 10/1987 | Swift | 292/318 |
| 5,114,196 | 5/1992 | Storer | 292/307 R |
| 5,116,091 | 5/1992 | Swift | 292/318 |
| 5,118,148 | 6/1992 | De Lima Castro Netto | 292/307 R |
| 5,402,958 | 4/1995 | Mahaney | 242/388.1 |
| 5,427,423 | 6/1995 | Georgopoulos | 292/320 |

FOREIGN PATENT DOCUMENTS

| | | |
|---|---|---|
| 2262421 | 7/1973 | Germany . |
| 2168654 | 12/1985 | United Kingdom . |

*Primary Examiner*—Rodney M. Lindsey
*Attorney, Agent, or Firm*—Dowell & Dowell

[57] ABSTRACT

A tamper resistant seal and a method of sealing an object using the tamper resistant seal are disclosed. The seal includes a receptacle and an insert adapted to be received in the receptacle. A tamper indicating wire is partially embedded in the insert and protrudes from an end of the insert. When the seal is assembled the insert is received in the receptacle and the wire extends along channels formed in opposite faces of the insert. If the wire is severed or removed from the channels by a tamperer attempting to break the seal, the structure of the channels prevents the wire from being repositioned therein to give a false indication of non-tampering. In addition, the receptacle is transparent to enable the wire to be visually examined to determine whether tampering has occurred.

15 Claims, 2 Drawing Sheets

TAMPER RESISTANT SEAL AND METHOD OF SEALING AN OBJECT

CROSS-REFERENCE TO RELATED APPLICATIONS

This is a continuation-in-part of U.S. patent application Ser. No. 08/375,691, filed Jan. 20, 1995 now abandoned.

BACKGROUND OF THE INVENTION

1. Field of the Invention

The invention relates to a tamper resistant seal including tamper indicating structure which can be visually inspected to determine whether tampering has occurred.

The invention further relates to a method of sealing an object using a tamper resistant seal in accordance with the invention.

2. Discussion of the Related Art

Tamper resistant seals having tampering indicating structure are known. For example, German Patent No. 2,262,421 discloses a seal comprising an insert having two channels located on its opposed outer faces, and a receptacle having an internal cavity for receiving the insert. The insert and receptacle are connected to each other by a first filament. The seal further comprises a second filament secured at one end to the insert.

To seal an object, the free end of the second filament is passed through an opening in the object and then wrapped around the insert, such that the second filament passes through both channels and its free end protrudes from the top of the insert. The second filament includes a bent portion extending between the bottom ends of the channels.

To assemble the seal, the insert is inserted in the receptacle. Flanges formed on the insert prevent its removal from the receptacle. To tamper with the seal without breaking the flanges, the second filament must be pulled out of both of the channels of the insert. To then return the seal to the non-tampered condition, the second filament must be threaded through the first channel, across the bottom of the insert and upward through the second channel, until the free end of the second filament protrudes from the top of the assembled seal.

For such seals, if the second filament is severed after being removed from the channels, it may be possible to thread separate portions of the second filament through both of the channels of the assembled seal to present a false indication that tampering has not occurred. Such seals lack tamper indicating structure which positively reveals that tampering has occurred.

Other known tamper indicating seals are disclosed in U.S. Pat. Nos. 2,599,700 to di Palma, 2,988,391 to Erke and 3,591,223 to Castro Neto, and United Kingdom Patent 2,168,654A.

SUMMARY OF THE INVENTION

The present invention has been made in view of the above described inadequacies of the known seals and has as an object to provide a seal which is tamper resistant.

Another object of the present invention is to provide a method of sealing an object using the tamper resistant seal of the invention.

To achieve the objects of the invention, as embodied and broadly described herein, the tamper resistant seal in accordance with a preferred embodiment of the present invention comprises a receptacle and an insert. The receptacle defines an internal cavity and includes a bottom wall formed of transparent material to permit visual inspection into the cavity. The receptacle further comprises a shaft which extends from an outer wall and has a knob at an end thereof.

The insert comprises a top portion and a body portion having opposed side faces and a bottom face. Two channels formed in the respective side faces extend the longitudinal length of the insert. The channels are offset in the width direction of the insert relative to each other.

A portion of a wire is embedded in the top portion and the body portion of the insert intermediate to the channels. A free portion of the wire protrudes from the top portion. The insert further comprises a strap formed integral with the top portion and having a socket to pivotally receive the knob of the receptacle.

In the assembled condition of the seal, the wire passes along one of the channels, around the bottom face, along the other channel and protrudes from the top portion of the insert. The flanges are received in the internal cavity of the receptacle and cooperatively abut inner surfaces that prevent the insert from being removed from the receptacle.

In another preferred embodiment of the seal in accordance with the invention, the sidewalls of the channels and the outer surface of the wire are contoured, to securely retain the wire in the channels when the seal is assembled.

The method of sealing an object comprises initially providing a tamper resistant seal in accordance with the present invention. Next, the wire is passed through an opening of the item to be sealed, seated along one of the channels, bent around the bottom face of the insert, and seated along the other channel, such that the wire protrudes from the top portion.

The seal is assembled by inserting the insert in the receptacle to position the flanges in the internal cavity. In the assembled condition, the wire can be visually inspected through the receptacle to determine whether tampering of the seal has occurred. A non-tampered condition is positively indicated by the wire extending continuously between the channels at the bottom face of the insert, and protruding from the top portion of the insert.

DETAILED DESCRIPTION OF THE PREFERRED EMBODIMENTS

Reference will now be made to preferred embodiments of the invention, as illustrated in the accompanying drawings.

Figure 1:
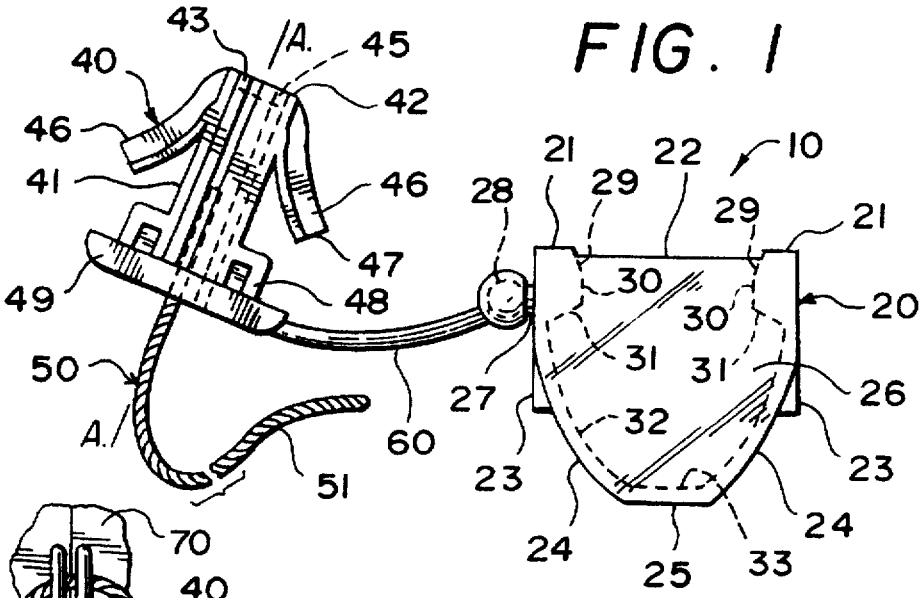
FIG. 1 is a side plan view of a tamper resistant seal in accordance with a preferred embodiment of the invention as unassembled.

FIG. 1 illustrates a tamper resistant seal 10 in accordance with a preferred embodiment of the present invention. The tamper resistant seal comprises two separate elements; namely, a receptacle 20 and an insert 40. The illustrated receptacle 20 has a generally heart-shaped exterior configuration. The receptacle comprises a top wall 21 which defines an opening 22, side walls which include opposed flat portions 23, arcuate-shaped portions 24 and flat, parallel front and rear portions 26, and a flat bottom wall 25.

In accordance with the invention, preferably at least the bottom wall 25 of the receptacle 20 is formed of a transparent material to enable the interior of the receptacle to be visually inspected. The receptacle may alternatively be formed entirely of a transparent material, and more preferably a transparent plastic material, to enable visual inspection through its entire outer surface as described in greater detail hereinbelow.

As illustrated in FIG. 1, a shaft 27 is formed integral with a flat side portion 23 of the receptacle. The shaft preferably has a minimal length, approximately equivalent to its thickness. A spherical-shaped knob 28 is formed at the free end of the shaft.

The walls of the receptacle define an internal cavity for receiving the insert 40 between first inner inclined surfaces 29, second inner surfaces 30, third inner inclined surfaces 31, inner concave surfaces 32 and a bottom inner surface 33. The cavity is closed to the exterior except for at the opening 22.

Figure 4:
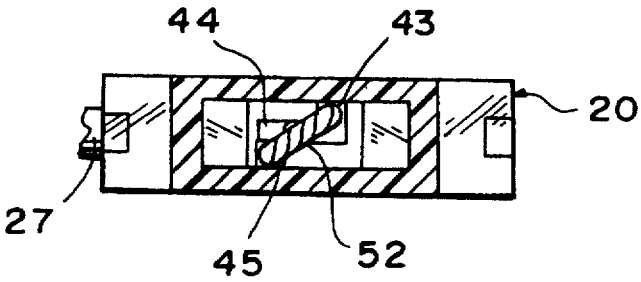
FIG. 4 is a cross-sectional view taken along line 4—4 of FIG. 3.

The insert 40 comprises a body portion 41 having a longitudinal central axis A—A. The body portion includes a bottom face 42, a first, front channel 43 formed in a front face and disposed at one side of the axis A—A, and a second, rear channel 45 formed on a rear face, at the opposite side of axis A—A relative to the front channel 43. The channels are open and preferably semi-circular or U-shaped. The channels are approximately equally spaced in the width direction of the insert relative to the axis A—A. As illustrated in FIG. 4, the channels extend along the longitudinal length of the insert and are connected at the bottom face 42 by a diagonally oriented connecting channel 44.

The insert 40 comprises a pair of flanges 46 formed integral with the body portion 41, and oriented at an obtuse angle with respect to the axis A—A. The flanges 46 are sufficiently resilient to be compressed inwardly toward the body portion, and then return to their non-compressed state (FIG. 1) after the compressive force is removed. The flanges have flat faces 47 at their free ends.

Figure 3:
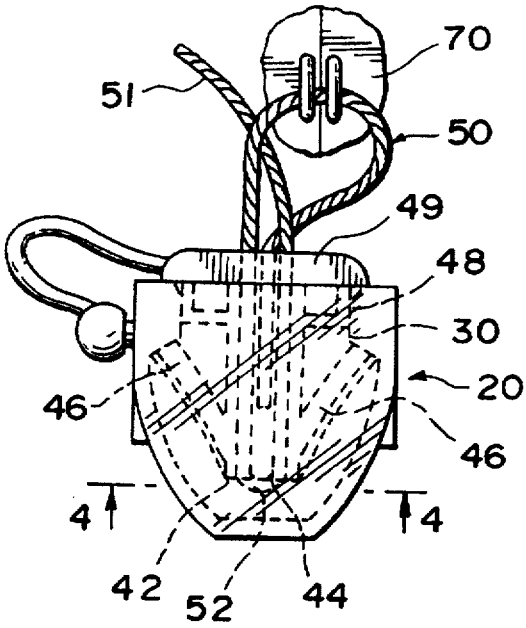
FIG. 3 illustrates the tamper resistant seal of FIG. 2 as assembled.

The insert 40 further comprises L-shaped legs 48 formed integral with the body portion 41, and a top portion 49. As illustrated in FIG. 3, the top portion is sized to cover the opening 22 of the receptacle when the seal is assembled. The channels 43 and 45 extend through the thickness of the top portion 49 on the front and rear faces, respectively, of the insert.

As illustrated in FIG. 1, a flexible strap 60 is integral with the top portion 49 of the insert. A socket 61 is provided at the free end of the strap to receive the spherical-shaped knob 28 on the receptacle to form a ball and socket-type hinge joint, about which the insert pivots.

The insert 40 further comprises a wire 50 partially embedded in the top portion 49 and the body portion 41 during the molding of the insert. As illustrated in FIG. 1, the wire 50 is positioned intermediate the front channel 43 and the rear channel 45. Because the wire is embedded along a significant length of the insert, it is firmly anchored. Herein, the portion 51 of the wire that is not embedded in the insert is referred to as the "free portion".

The wire 50 is preferably composed of a corrosion resistant metal, and may optionally be composed of a plastic material. The wire may be provided in different lengths depending upon the intended use of the seal. The wire preferably has a diameter such that it fits closely in the channels of the insert when the seal is assembled. To enhance inspection of the wire, it is preferably colored so as to contrast with the insert.

Figure 5:
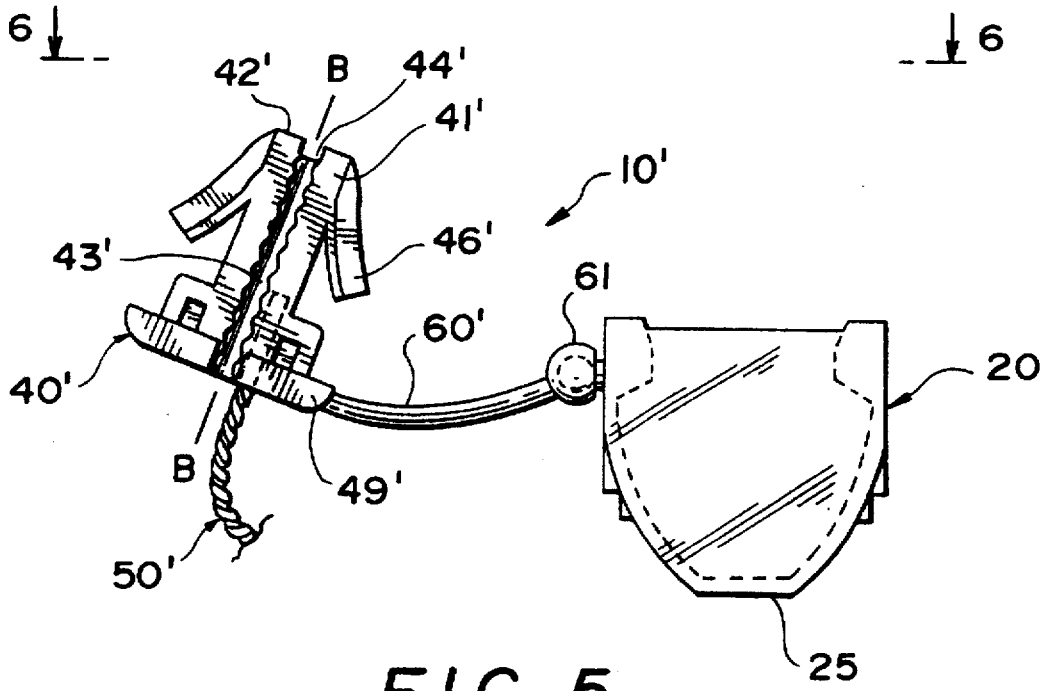
FIG. 5 is a side plan view of a further embodiment of the tamper resistant seal in accordance with the invention as unassembled.
Figure 6:
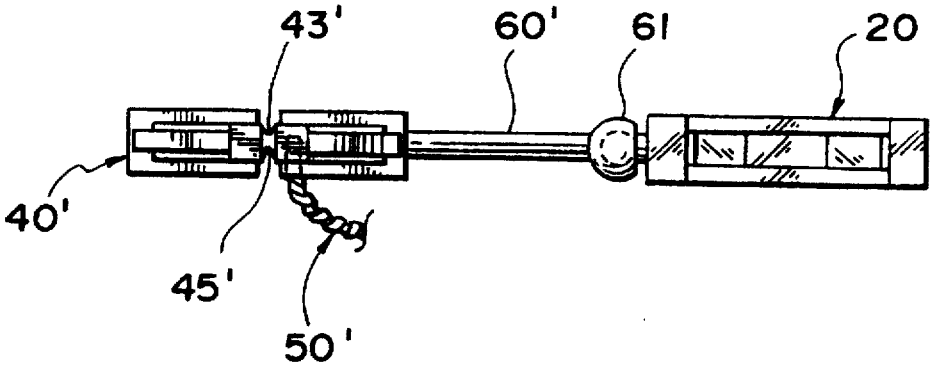
FIG. 6 is a plan view taken in the direction of line 6—6 of FIG. 5.

FIGS. 5 and 6 illustrate another embodiment of the tamper resistant seal in accordance with the present invention. The insert 40' includes a body portion 41' having opposed outer faces in which a front channel 43' and a rear channel 45' are formed. The channels are preferably aligned in the width direction of the insert and lie along a common plane passing through the axis B—B. The front and rear channels are connected at a bottom face 42' of the insert by a connecting channel 44'.

The opposed sidewalls of the channels 43' and 45' have a contoured surface profile along their lengths (as shown only for channel 43'). The sidewalls may have a saw-tooth contour or the like.

A wire 50' is partially embedded in the insert at one side of the channels 43' and 45'. The contour of the outer surface of the wire is preferably substantially the same as the contour of the sidewalls of the channels 43' and 45', so that the wire cannot be pulled out of the channels once the seal is assembled. The contour of the outer surface of the wire may be varied to match the contour of the sidewalls of the channels.

In this embodiment of the seal, the bottom wall 25 only, or the entire receptacle, may be formed of a transparent material.

Figure 2:
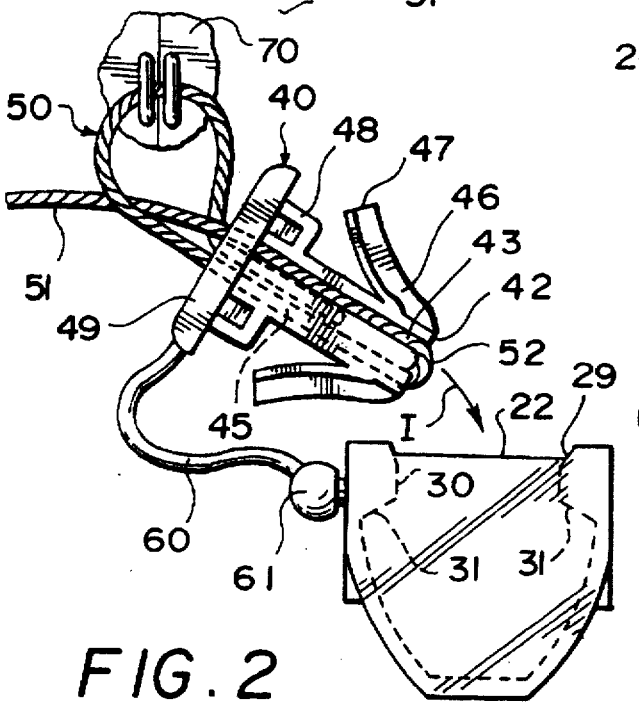
FIG. 2 is an illustrational view of the tamper resistant seal of FIG. 1 depicting the wire passed through an object to be sealed and through both channels of the insert which is to be inserted in the receptacle.

The use of the seal of the present invention will now be described with reference to the embodiment illustrated in FIGS. 1–4. Referring to FIG. 2, initially the free portion 51 of the wire 50 is passed through openings of an object 70 to be sealed, such as a pair of doors or the like. The wire is then seated along the rear channel 45 (FIGS. 2–4) such that it protrudes from the bottom face 42 of the insert. The free portion of the wire is bent around the bottom face, seated in the connecting channel 44 (FIG. 4), and then seated along the length of the front channel 43 such that a length of the wire protrudes from the top portion 49 of the insert.

The portion of the wire that is bent around the bottom face of the insert is referenced 52. FIGS. 3 and 4 illustrate the bent portion 52 of the wire extending across the connecting channel 44 between the channels 43 and 45, close to the bottom wall 25 of the receptacle.

Referring to FIGS. 2 and 3, the insert 40 is next rotated about the knob 28 as indicated by arrow I, and the bottom end of the insert is placed within the opening 22 of the receptacle 20. The body portion 41 of the insert is then pushed into the receptacle to force the flanges 46 past the first inner inclined surfaces 29, the second inner surfaces 30 and below the third inner inclined surfaces 31. During insertion, the flanges are flexed inward by the first and second inner surfaces. After the flat faces 47 of the flanges have passed the second inner surfaces 30, the flanges flex outwardly and return to their non-compressed state. As illustrated in FIG. 3, the flat faces abut the third inner inclined surfaces and prevent the insert from being pulled out of the receptacle without breaking the flanges. The legs 48 of the insert abut the second inner surfaces 30 to prevent sideward motion of the insert.

To assemble the tamper resistant seal 10' of the embodiment of the invention illustrated in FIGS. 5 and 6, initially the free portion 51' of the wire 50' is passed through an opening of an object (not shown), and then seated along the rear channel 45', such that the wire protrudes from the bottom face 42' of the insert. The wire is then bent around the bottom face, seated in the connecting channel 44' and seated along the length of the front channel 43' such that it protrudes from the top portion 49'.

Next, the insert 40' is inserted into the receptacle 20 in the same manner as described above with respect to the seal of FIGS. 1–4.

The seal 10' provides the further advantage that the wire 50' is prevented from being pulled out of the channels 43' and 45' of the insert 40' by the cooperative engagement between the contoured sidewalls of the channel and outer surface of the wire.

FIG. 3 illustrates the non-tampered condition of the seal 10. To remove the seal from the object 70, a tamperer may force the insert out of the receptacle and consequently break the flanges 46. It would then be readily apparent, however, that tampering had occurred.

A tamperer may alternatively attempt to pull the wire 50 completely out of the channels 43 and 45 of the insert. The present invention provides the advantage, however, that even if the wire is somehow removed and then severed, the offset channels make it virtually impossible to thread the wire back through both of the channels when the seal is re-assembled to provide the appearance of non-tampering.

The offset channels require tamperers to thread the wire first through one channel, and then force the wire to enter the other channel. For the free end of the wire to enter the other channel, it must be turned at a sharp angle and caused to move directly toward the other channel, and then once the wire is at the bottom end of the other channel, sharply bent to enable it to enter the other channel. The tamperer must then force the wire upward through the other channel until a portion of the wire extends from the top portion of the insert as illustrated in FIGS. 2 and 3. Because the channels are offset and approximately the same size as the wire, this scenario would be virtually impossible to accomplish.

For each embodiment of the invention, once the seal is assembled, it is simple to subsequently determine by visual inspection whether tampering has occurred. The observance of a portion of the wire positioned in the connecting channel and the free portion of the wire protruding from the top portion of the insert, indicates a non-tampered condition of the seal.

Furthermore, because the seal comprises a separate receptacle and insert, it does not require such a complex die for the molding process as the known seals having one-piece constructions.

The foregoing description of the preferred embodiment of the invention has been presented to illustrate the principles of the invention and not to limit the invention to the particular embodiments illustrated. It is intended that the scope of the invention be defined by all of the embodiments encompassed within the following claims, and their equivalents.

What is claimed is:

1. A tamper resistant seal comprising:

a receptacle having an internal cavity;

an insert adapted to be received in said internal cavity in an assembled condition of the seal, said insert including a body portion and a top portion, said body portion having first and second side faces and a bottom face, a first channel formed in said first side face and a second channel formed in said second side face, said first and second channels each including opposing sidewalls and having a first contoured surface profile including a plurality of spaced projections and recesses; and a wire secured to said insert, said wire having an outer surface contour including a plurality of spaced projections and recesses of a size to be cooperatively seated within said spaced recesses and projections, respectively, of said first and second channels, said wire being adapted to pass along said first channel, around said bottom face, along said second channel and protrude from said top portion when the seal is assembled with said wire interlocked between said recesses and spaced projections of said first and second channels.

2. The tamper resistant seal of claim 1, further comprising a strap integral with said insert and having a socket disposed at a free end, a knob integral with said receptacle and extending outwardly therefrom, said socket pivotally receiving said knob to form a pivot joint about which said insert pivots.

3. The tamper resistant seal of claim 2, wherein said body portion of said insert includes resilient flanges, said receptacle includes opposed side walls each having an inner inclined surface, said resilient flanges cooperatively abut the inner inclined surfaces when the seal is assembled to prevent said insert from being removed from said receptacle.

4. The tamper resistant seal of claim 3, wherein said receptacle includes a transparent bottom wall to permit visual inspection of said wire in said internal cavity when the seal is assembled.

5. The tamper resistant seal of claim 1 wherein said projections of said first and second channels extend from each of said sidewalls thereof.

6. A tamper resistant seal comprising:

a receptacle having an internal cavity;

an insert adapted to be inserted in said internal cavity to assemble the seal, said insert including a body portion having opposite sides, a top portion and bottom face and a longitudinal axis extending intermediate said opposite sides and between said top portion and bottom face and further including first and second oppositely oriented outer faces, a first channel formed in said first outer face and a second channel formed in said second outer face, said first and second channels extending longitudinally along said body portion from said top portion, said first channel being spaced so as to be offset in a width direction toward one of said opposite sides as measured from said longitudinal axis from said second channel;

a connecting channel in said bottom face of said insert communicating said first and second channels with one another;

a wire having a first portion connected to said insert and a second portion adapted to extend along said first channel then diagonally over said bottom face and then along said second channel and outwardly from said top portion when the seal is assembled; and a strap connecting said insert to said receptacle.

7. The tamper resistant seal of claim 6 including means for pivotably connecting said insert to said receptacle.

8. The tamper resistant seal of claim 7, wherein said first portion of said wire is embedded within said top portion and said body portion of said insert intermediate said first and second channels.

9. The tamper resistant seal of claim 8, wherein said receptacle includes a transparent bottom wall to enable visual inspection of said wire within said internal cavity when the seal is assembled.

10. The tamper resistant seal of claim 9, wherein said strap includes a socket disposed at a free end thereof, and a knob extends from said receptacle and is frictionally retained within said socket.

11. A seal for detecting tampering comprising:

a receptacle having an interior cavity and an opening into said cavity and an end wall opposite said opening;

an insert including a body portion having first and second oppositely oriented outer faces, a bottom face and a top portion, a first channel formed in said first outer face and a second channel formed in said second outer face, at least one of said first and second channels having a first contoured surface profile including a plurality of projections and recesses;

a wire secured to said insert, said wire having a second outer contoured surface profile including a plurality of spaced projections and recesses of a configuration to interlock with said recesses and projections, respectively, of said at least one of said first and second channels;

said wire being of a length to extend along one of said first and second channels, around said bottom face of said insert, and along the other of said first and second channels such that a portion of said wire protrudes outwardly from said top portion when said insert is inserted through said opening into said cavity of said receptacle.

12. The seal of claim 11, further comprising a strap secured to said insert and having a socket disposed at a free end, and a knob integral with said receptacle and being pivotally received in said socket to form a pivot joint about which said insert pivots.

13. The seal of claim 12, wherein said body portion of said insert includes integral resilient flanges, said receptacle comprises opposed side walls each having an inner inclined surface, and said flanges of said insert cooperatively abut the inner inclined surfaces when the seal is assembled to prevent said insert form being removed from said receptacle.

14. The seal of claim 13, wherein said bottom wall of said receptacle is formed of a transparent material.

15. The seal of claim 14, wherein said receptacle is formed entirely of a transparent material.

* * * * *